US005113907A

United States Patent [19]

Russell

[11] Patent Number: 5,113,907

[45] Date of Patent: May 19, 1992

[54] DYNAMIC SELF-MONITORING AIR OPERATING SYSTEM

[75] Inventor: Neil E. Russell, Bloomfield Hills, Mich.

[73] Assignee: Ross Operating Valve Company, Troy, Mich.

[21] Appl. No.: 647,601

[22] Filed: Jan. 29, 1991

[51] Int. Cl.[5] ..... F15B 13/043; F15B 20/00

[52] U.S. Cl. ..... 137/596.16; 91/424; 91/448

[58] Field of Search ..... 91/424, 448; 137/596.16

[56] References Cited

U.S. PATENT DOCUMENTS

| | | | |
|---|---|---|---|
| Re. 28,520 | 8/1975 | Mahorney et al. . | |
| Re. 30,403 | 9/1980 | Bitonti . | |
| 1,290,865 | 1/1919 | Anthony . | |
| 2,051,732 | 8/1936 | McKee . | |
| 2,593,564 | 4/1952 | Ives . | |
| 2,906,246 | 9/1959 | Tirro et al. . | |
| 2,954,009 | 9/1960 | Juilfs . | |
| 2,995,141 | 8/1961 | Hipp . | |
| 3,170,484 | 2/1965 | Benz et al. | 91/424 X |
| 3,371,759 | 3/1968 | Sapolsky . | |
| 3,670,767 | 6/1972 | Mahorney . | |
| 3,757,818 | 9/1973 | Sweet . | |
| 3,834,621 | 9/1974 | Pacht et al. . | |
| 3,858,606 | 1/1975 | Cameron . | |
| 4,075,928 | 2/1978 | Bitonti . | |
| 4,181,148 | 1/1980 | Russell et al. . | |
| 4,257,455 | 3/1981 | Cameron . | |
| 4,269,225 | 5/1981 | Ruchser | 137/596.16 |
| 4,345,620 | 8/1982 | Ruchser et al. . | |
| 4,542,767 | 9/1985 | Thornton et al. . | |

FOREIGN PATENT DOCUMENTS

| | | |
|---|---|---|
| 1099294 | 8/1961 | Fed. Rep. of Germany . |
| 2002890 | 7/1971 | Fed. Rep. of Germany . |
| 2750895 | 5/1979 | Fed. Rep. of Germany . |
| 3032336 | 3/1981 | Fed. Rep. of Germany . |
| 41174A | 11/1965 | German Democratic Rep. . |
| 1294747 | 11/1972 | United Kingdom . |
| 2010448 | 6/1979 | United Kingdom . |
| 2057638A | 4/1981 | United Kingdom . |

OTHER PUBLICATIONS

Ross Operating Valve Co., "Air Controls" Catalog, pp. 801–816, Pressure Control Double Valves, 1989.

Herion Catalog, "Sivex Double Valve, Type XSz", Brochure 1101, 1986.

*Primary Examiner*—Gerald A. Michalsky

*Attorney, Agent, or Firm*—Harness, Dickey & Pierce

[57] ABSTRACT

A safety monitoring system is provided for a pneumatic control system having a double safety valve arrangement. The monitoring system is adapted for preventing further operation of the control system in response to a malfunction of either the double safety valve or the monitoring system itself. The monitoring system preferably includes constantly dynamic monitor valves, and also preferably includes a damper feature for substantially preventing premature, undesired shutdowns of the control system in accordance with predetermined system parameters.

20 Claims, 11 Drawing Sheets

DYNAMIC SELF-MONITORING AIR OPERATING SYSTEM

BACKGROUND AND SUMMARY OF THE INVENTION

The invention relates generally to monitoring systems for double pneumatic safety valves of the type used to control pneumatically-actuated clutches and/or brakes for presses or other such pneumatically-actuated devices.

In order to provide improved safety for pneumatically-actuated tools, such as stamping presses or the like, double safety valve assemblies have been provided between the pressurized air inlet and the supply to the pneumatically-operated device. In such arrangements, pressurized supply air cannot be supplied to the pneumatically-operated device from the pressurized air inlet unless both of the valve elements in the double safety valve are in an open position. The intent of such arrangements is that a malfunction of one of the valve elements will prevent continued actuation of the pneumatically-operated device.

However, because of various factors or features frequently found in such arrangements, it is sometimes possible for the pneumatically-actuated device to be partially operated even when one of the valve elements is stuck in an incorrect position or otherwise faulted. Whether such an undesirable malfunction can occur depends to some extent on whether the faulted valve is stuck in its closed position or in its open position. If if in its closed (or exhaust) position, it is less likely for the remaining valve to be capable of continuing to operate or actuate the system. If the stuck valve is in its open position, however, depending on the configuration of the system involved, it is sometimes possible to continue to at least partially operate the device with the remaining operable valve. In such an instance, the operator may not be aware of the malfunction or faulted condition of one of the valve elements unless an adequate monitoring system is present In other situations, even though normal operation cannot be continued in the event of one of the valve elements being in a stuck or otherwise faulted position, the pneumatically-actuated device may unexpectedly and undesirably partially actuate from a safe condition to an unsafe condition. Since this type of malfunction can occur with no warning, serious injury to personnel or property can result.

Thus, it has become advantageous and important to provide some form of monitoring system that will indicate to the operator that one or both of the valve elements is stuck or otherwise in a faulted condition. Various examples of double safety valve arrangements, with and without monitoring systems, can be found in the prior art, with such examples including the disclosures of U.S. Pat. Nos. 2,906.246; 3,757,818; 3,858,606; RE 28,250; 4,181,148; 4,257,255; 4,345,620; and 4,542,767. The disclosures of these references are thus hereby incorporated by reference herein for purposes of providing a background for the present invention.

In addition to the above, in pneumatic systems involving double safety valves of the type discussed herein, some monitoring systems include a feature that is intended to cause a safe shutdown of the pneumatic system for purposes of preventing undesirable or unsafe continued operation or partial actuation of the pneumatically-operated device. However, some of such monitoring systems have not adequately provided for such a safe shutdown of the system in all instances. Examples of such monitoring systems include those that are incapable of detecting a sticking or sluggish valve element, incapable of detecting whole or partial malfunctions of the monitoring system itself, or incapable of adequately safeguarding against actuation of the pneumatically-operated device when a reset function is operated without the malfunction of the double safety valve or the monitoring system being first properly corrected.

Thus, the need has arisen for a double safety valve system that provides adequate monitoring functions to inhibit further operation of the pneumatically-actuated device in the event that either of the valve elements in the double safety valve is out of sequence with the other valve element. In addition, it is an objective of the present invention to provide adequate safeguards inhibiting further operation in the event of a sticking or unacceptably sluggish monitoring valve element or other malfunction of the monitoring system itself. Thus, the present invention seeks to provide a double safety valve monitoring arrangement for pneumatic systems that is self-monitoring, both with respect to the double safety valves and with respect to the monitoring system itself.

The present invention also seeks to provide a monitoring system that is constantly dynamic during operation of the system in order to substantially reduce the possibility of a faulted, sticking, or sluggish valve element in the monitoring system itself. Still another objective of the present invention is to provide such a monitoring system wherein the amount of sluggishness or delay in valve element movement that will be tolerated before causing a shutdown of the system can be preselectively chosen or altered in order to suit the design parameters of a given installation.

Additional objectives, advantages, and features of the present invention will become apparent from the following description and appended claims, taken in conjunction with the accompanying drawings.

DETAILED DESCRIPTION OF THE PREFERRED EMBODIMENTS

Figure 1:
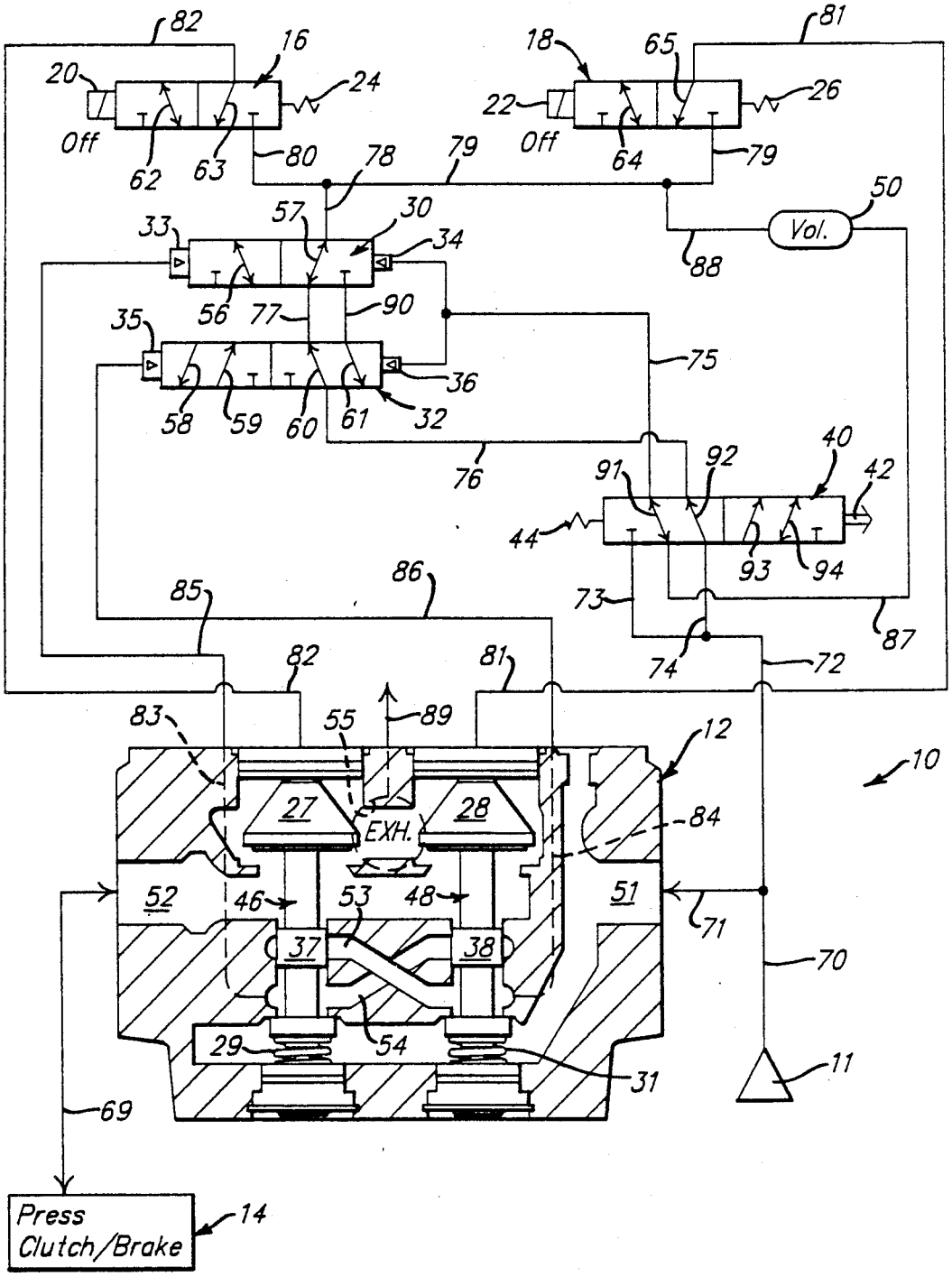
FIG. 1 is a diagrammatic or schematic view of an exemplary embodiment of a dynamic self-monitoring air operating system according to the present invention, showing the main poppet valve elements of the double safety valve in their exhaust positions.

FIGS. 1 through 7 diagrammatically illustrate an exemplary dynamic self-monitoring air operating system or control system 10 according to the present invention, with variations thereon being discussed below. One skilled in the art will readily recognize that the control system 10 depicted in the drawings is shown merely for purposes of illustration of the principles of the present invention. One skilled in the art will also readily recognize that the principles of the present invention are equally applicable to air operating or control systems other than that shown for purposes of illustration in the drawings.

Figure 2:
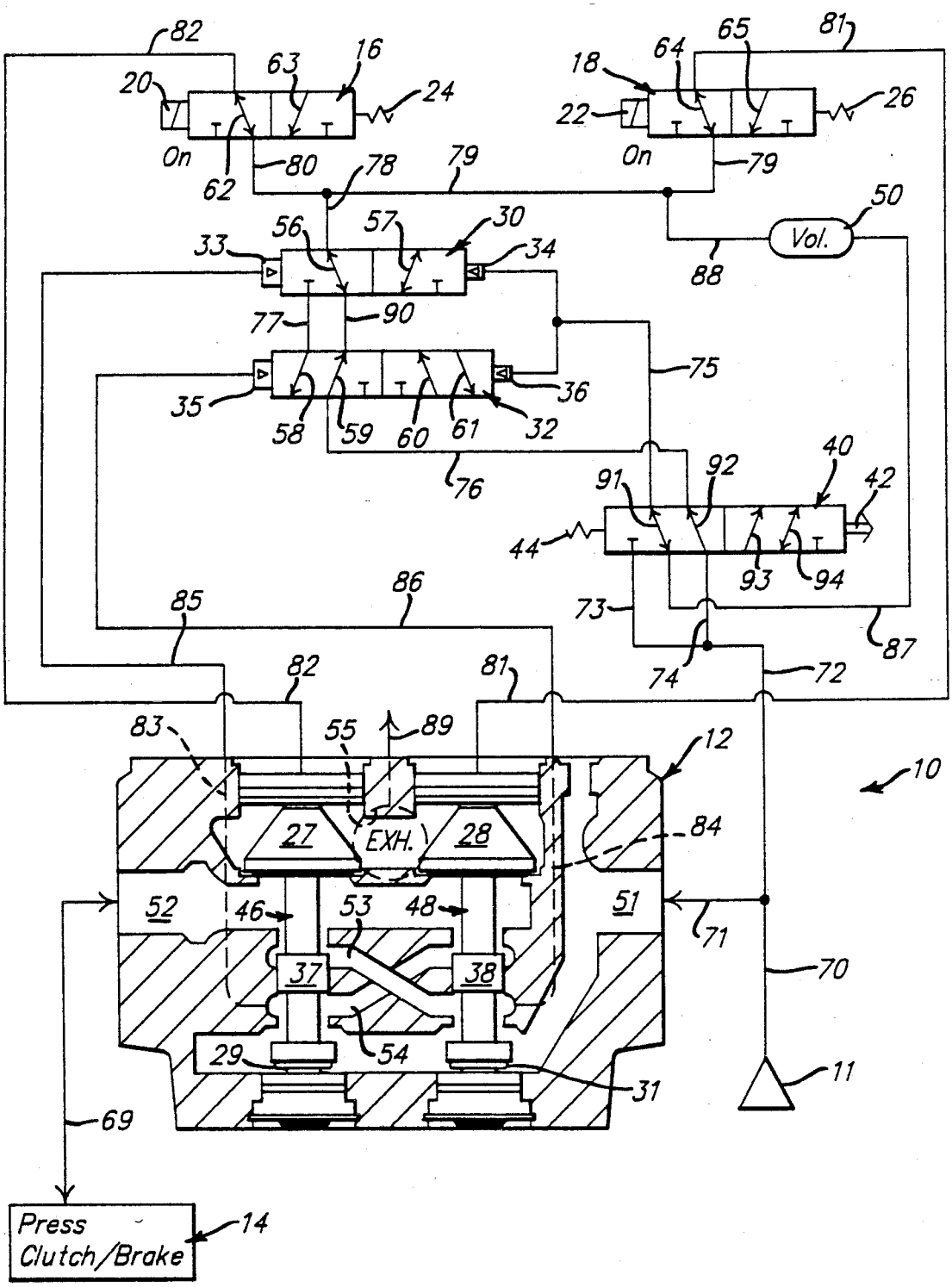
FIG. 2 is a diagrammatic view similar to that of FIG. 1, except that the main poppet valve elements of the double safety valves are shown in their open positions for supplying pressurized air to the pneumatically-operated device.

FIGS. 1 and 2 illustrate the normal operating modes or conditions of the exemplary control system 10 when no malfunction has occurred. The primary components of the control system 10 include a crossflow-type double safety control valve assembly 12, which controls the supply and exhaust of pressurized air between a pressurized air source 11 and a press clutch/brake mechanism 14, or a similar mechanism for actuating an air-operated device. Other primary components of the control system 10 include a pair of monitoring valves 30 and 32, a pair of pilot valves 16 and 18, a volume chamber 50, and a lockout/reset valve 40. The double safety control valve assembly 12 includes an inlet port 51, an outlet port 52, and an exhaust port 55. The inlet and outlet ports 51 and 52, respectively, are interconnected by crossflow passages 53 and 54, which are opened and closed for providing and blocking fluid communication between the inlet and outlet ports 51 and 52, respectively, by way of movement of poppet valve elements or members 46 and 48. The movements of the poppet valves elements 46 and 48 are actuated by way of respective piston/exhaust valve assemblies 27 and 28, which are in turn actuated or deactuated by way of the supply or exhaust of pressurized pilot error from the above-mentioned pilot valves 16 and 18, respectively, as well as by the resilient biasing force of the return springs 29 and 31.

The monitoring valve 30 preferably includes a pair of flow-through ports 56 and 57, the positions of which are controlled by pneumatic actuators 33 and 34. Similarly, the monitoring valve 32 includes flow-through ports 58, 59, 60, and 61, the positions of which are controlled by pneumatic actuators 35 and 36.

The pilot valves 16 and 18 include respective pairs of flow-through ports 62 and 63, and 64 and 65, the positions of which are controlled by solenoids 20 and 22, respectively, or by way of similar well-known valve actuators, as well as by the respective return springs 24 and 26.

The lockout/reset valve 40 preferably includes a number of flow-through ports 91, 92, 93, and 94, the positions of which are controlled by the manual actuation element 42 and the return spring 44. As is described in more detail below, the lockout/reset valve 40 is operable in order to reset the control system 10 to its proper, normal operating condition after a malfunction or faulted condition has occurred and been corrected.

The various ports of the various primary elements of the control system 10 are interconnected by numerous pressurized air lines, which are identified below in connection with a description of their function in the context of a description of the operation of the control system 10.

As illustrated in FIG. 1, the control system 10 is initially in a non-supply operating mode, in which pressurized air is exhausted from the press clutch/brake mechanism 14, either when the press or other controlled device is not operating, or when it is in an exhaust mode during normal operation. This condition results from the position of the poppet valve members 46 and 48, wherein the piston/exhaust valve assemblies 27 and 28, respectively, are in their open positions, thus providing fluid communication between the press clutch/brake mechanism 14 and the exhaust port 55, by way of the line 69 and the outlet port 52.

Furthermore, because of the positions of the pilot valves 16 and 18, caused by the solenoids 20 and 22, respectively, being in their "off" positions, the pressurized air source 11 is in communication with the volume chamber 50, which in turn provides pressurized air to the pneumatic actuators 34 and 36 in order to maintain the monitoring valves 30 and 32, respectively, in their left-hand positions. Such fluid communication between the pressurized air source 11 and the volume chamber 50 is provided by way of the lines 70, 72, and 74, the port 92 in the lockout/reset valve 40, the lines 76, 77, 78, 79, and 88, by way of the ports 57 and 60 of the monitoring valves 30 and 32. The fluid communication between the volume chamber 50 and the pneumatic actuators 34 and 36 is provided by way of the line 87, the port 91 of the lockout/reset valve 40, and the line 75. However, because of the left-hand positions of the pilot valve 16 and 18, as viewed in the diagrammatic representation in FIG. 1, the lines 80 and 79 are blocked off, thus providing a "closed", pressurized fluid communication path from the pressurized air source 11, through the monitoring valves 30 and 32, through the volume chamber 52, to the pneumatic actuators 34 and 36. This in turn maintains the monitoring valves 30 and 32 in their left-hand positions diagrammatically represented in FIG. 1. In addition, this prevents pilot air from flowing through the lines 81 and 82, thus preventing actuation of the poppet valve elements 46 and 48 to their open positions, and in turn preventing flow through the crossflow passages 53 and 54 from the inlet 51 to the outlet 52.

As illustrated in FIG. 2, when the solenoids 20 and 22 are actuated to their "on" positions, the respective pilot valves 16 and 18 are shifted to their right-hand positions, as viewed in FIG. 2, thus providing fluid communication from the respective lines 79 and 80, through the respective lines 81 and 82, to the piston/exhaust valve assemblies 27 and 28, respectively. Such fluid communication is provided by way of the port 62 in the pilot valve 16 being aligned with the lines 80 and 82 in order to provide pressurized air to urge the poppet valve element 46 downwardly against the force of the return spring 29. Similarly, the port 64 of the pilot valve 18 provides fluid communication between the lines 79 and the line 81, in order to provide pressurized air to urge the piston/exhaust valve assembly 28 and the poppet valve element 48 downwardly against the force of the return spring 31. Such a condition results in the poppet valve elements 46 and 48 opening fluid communication between the inlet 51 and the outlet 52 of the double safety control valve 12, as well as closing off communication between the outlet 52 and the exhaust port 55. As a result, pressurized air is also supplied to the monitoring ports 83 and 84 of the control valve 12, which communicate by way of the air lines 85 and 86, respectively, in order to supply pressurized air to the pneumatic actuators 33 and 35 of the monitoring valves 30 and 32, respectively.

Because the pneumatic actuators 33 and 35 are larger than the opposite respective pneumatic actuators 34 and 36, or are otherwise designed to overpower the respective pneumatic actuators 34 and 36, when pressurized air is supplied to the pneumatic actuators 33 and 35, the monitoring valves 30 and 32 are shifted rightwardly, as viewed in FIG. 2. Such rightward shifting of the monitoring valves 30 and 32 results in continued supply of pressurized air from the pressurized air source 11 to the piston portions of the piston/exhaust valve assemblies 27 and 28 of the control valve 12. Such continued supply of pressurized air is provided by way of the lines 70, 72, and 74, through the port 92 of the lockout/reset valve 40, and through the lines 76, 90, and 78, and through the respective lines 81 and 82, by way of the flow-through ports 59 and 56 of the monitoring valves 30 and 32, respectively. In such a condition, the volume chamber 50 is continuously provided with pressurized air by way of the lines 78, 79, and 88. The volume chamber 50 continues to supply such pressurized air to the pneumatic actuators 34 and 36, by way of the lines 87 and 75, through the port 91 of the lockout/reset valve 40, but such supply of pressurized air to the pneumatic actuators 34 and 36 is overcome by the force exerted on the respective monitoring valves 30 and 32, as a result of pressurized air being supplied to the pneumatic actuators 33 and 35, respectively.

Referring to FIGS. 1 and 2, when the solenoids 20 and 22 of the respective pilot valves 16 and 18 are deactuated to their "off" positions, as shown in FIG. 1, the lines 81 and 82 are exhausted through the ports 65 and 63, thus allowing the force of the return springs 29 and 31 to urge the poppet valves 46 and 48 upwardly to exhaust the press clutch/brake mechanism 14 by way of the line 69, the outlet port 52, and the exhaust port 55. Simultaneously, at least during initial opening of the piston/exhaust valve assembly 27 and 28, the valve members 37 and 38 of the poppet valve assemblies 46 and 48, respectively, have not yet fully closed, thus allowing a preselected amount of leakage in order to exhaust the monitoring ports 83 and 84, the lines 85 and 86, and thus the pneumatic actuators 33 and 35, respectively. As a result, because of the pressurized air being stored in the volume chamber 50, the pneumatic actuators 34 and 36 of the monitoring valves 30 and 32, respectively, are in a condition to overcome the force of the respective pneumatic actuators 33 and 35, thus shifting the monitoring valves 30 and 32 to their respective left-hand positions illustrated in FIG. 1. At this point in the operation, the control system 10 is returned to its exhaust, or at-rest, condition illustrated in FIG. 1, and is ready to resume actuation to its supply condition illustrated in FIG. 2 upon re-actuation of the solenoids 20 and 22, as described above.

Thus, as described above with reference to FIGS. 1 and 2, a complete, normal operating cycle of the control system 10 has been disclosed. It is important to note that each such complete operating cycle involves not only a complete cycle of movement of the poppet valves 46 and 48 of the control valve 12, but also a complete rightward and leftward movement of each of the monitoring valves 30 and 32, as well as the pilot valves 16 and 18. Such complete rightward and leftward cyclical movement of the monitoring valves 30 and 32 results in the dynamic nature of the self-monitoring subsystem of the control system 10. Such constantly dynamic movement of the monitoring valves 30 and 32 not only significantly contributes to their proper operation and lack of a tendency to stick in one position, but also functions to allow the monitoring subsystem to be self-monitoring, as is described in more detail below.

Figure 3:
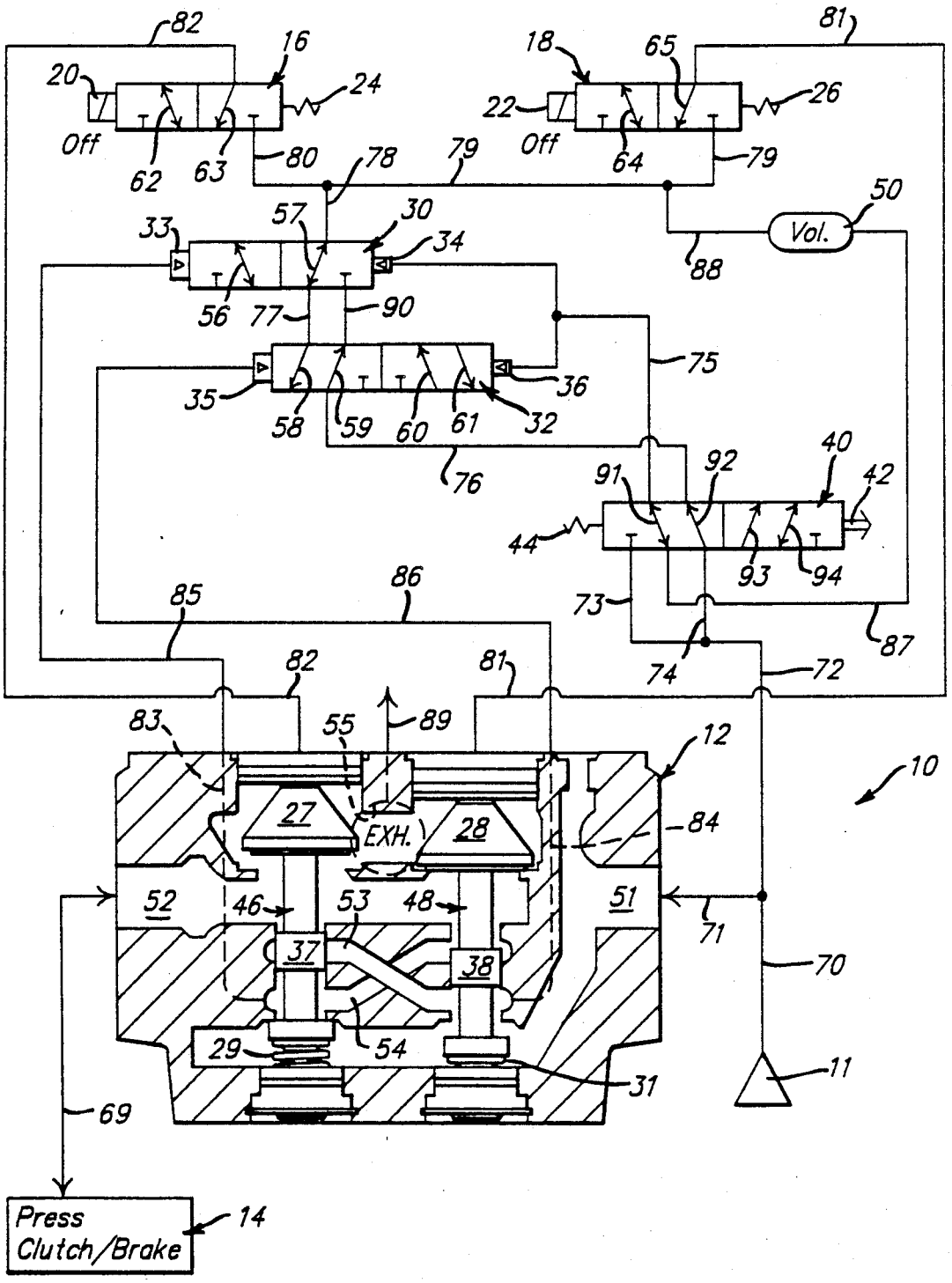
FIG. 3 is a diagrammatic view showing an exemplary malfunction or faulted condition, wherein the right-hand poppet valve element, as viewed in FIG. 3, is stuck in its open position and is thus out of sequence with the properly-positioned left-hand poppet valve element.
Figure 4:
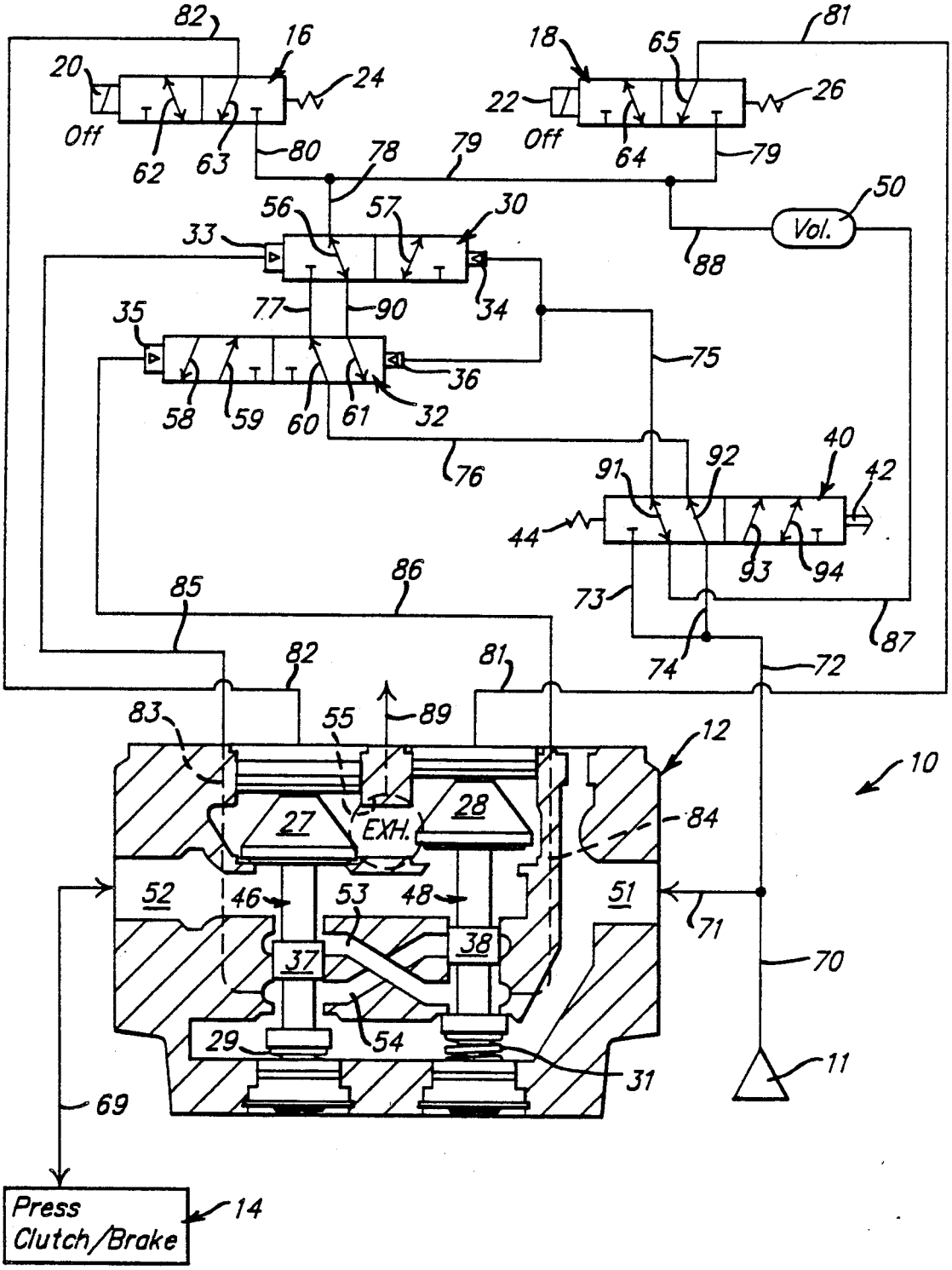
FIG. 4 is a view similar to that of FIG. 3, showing another exemplary faulted condition, wherein the left-hand poppet valve element is stuck in its open position and is thus out of sequence with the properly positioned with the right-hand poppet valve element.

FIGS. 3 and 4 illustrate two alternate versions of a malfunction or faulted condition resulting from the sticking or unacceptably slow, sluggish movement of one of the poppet valve members 46 or 48, such that one of the poppet valves is out of sequence with the other. In FIG. 3, the solenoids 20 and 22 have been deactuated to their "off" conditions, thus signalling for a return to the exhaust, or at-rest, condition illustrated in FIG. 1. However, instead of returning to its exhaust position, poppet valve assembly 48 has stuck or otherwise remained in its "open" or supply position. The double safety control valve 12 thus functions to substantially prevent the supply of pressurized air from the pressurized air source 11, through the inlet and outlet ports 51 and 52, respectively, to the press clutch/brake mechanism 14, as a result of the outlet port 52 being connected with the exhaust port 55. Upon reactuation of the solenoids 20 and 22 without the above-described monitoring subsystem, the poppet valve assembly 46 could again be urged to its "open" or supply position, thus allowing for continued whole or partial operation of the press clutch/brake mechanism 14. However, because of the function of the monitoring subsystem, such a result is prevented, and the control system 10 is safely shutdown, thus alerting the operator of a malfunction or faulted condition.

Such a shutdown occurs in the condition diagrammatically illustrated in FIG. 3 by way of pressurized air being provided from the inlet 51 and the open crossflow passage 53, through the monitoring port 84 and the line 86, to the pneumatic actuator 35, with this pressurized air thus maintaining the monitoring valve 32 in its rightwardly-shifted position. As a result, the port 59 of the monitoring valve 32 remains aligned with the line 90, but the line 90 is blocked off by the properly leftwardly-shifted position of the monitoring valve 30 in order to prevent pressurized air from the source 11 from flowing to either the pilot valves 16 and 18 or the volume chamber 50. Similarly, because the port 57 of the properly leftwardly-shifted monitoring valve 30 interconnects the lines 78, 79 and 88 with the line 77 and the port 58 of the rightwardly-shifted monitoring valve 32, the volume chamber 50 is similarly exhausted, and thus the monitoring valve 30 stays in its leftward position.

Reactuation of the solenoids 20 and 22 to urge the pilot valve 16 and 18 rightwardly, when the system 10 is in the condition shown in FIG. 3, will result in the lines 82 and 81 also being connected, by way of the ports 62 and 64 of the pilot valves 16 and 18, respectively, with the respective lines 80 and 79, which are connected to exhaust by way of the line 78, the port 57 of the monitoring valve 30, the line 77, and the port 58 of the monitoring valve 32. This result prevents the poppet valve assembly 46 from being urged downwardly to its "open" or supply position by preventing pilot air pressurization of the lines 81 and 82. Thus, since the functioning poppet valve assembly 46 cannot be moved when the control system 10 is in the condition illustrated in FIG. 3, and because the flow of pressurized air from the pressurized air source 11 is blocked off, the control system 10 is shutdown and rendered inoperable as a result of the malfunction or faulted condition of the poppet valve assembly 48.

It should be noted, however, in connection with the malfunction condition illustrated in FIG. 3, that such a safe shutdown of the system 10 occurs even in response to a mere sluggish response of the valve element 38, short of a complete sticking of the valve element 38. However, in order to avoid premature shutdowns, to function as a damper for the system, and to accommodate normal tolerances of system components or other design parameters of a given installation, a quantity of pressurized air is stored in the volume chamber 50, which depends of course upon the preselected size of the volume chamber 50. As a result, the above-described exhausting of the volume chamber 50 does not occur instantaneously, and thus the stored pressurized air in the volume chamber 50 will function for a predetermined period of time to cause the actuator 36 to urge the monitoring valve 32 leftwardly when the sluggish valve element 48 returns to its exhaust position after a momentary sticking or at the end of a slow, sluggish movement. If, however, such sticking of the valve element 48 lasts too long, or if it is too sluggish in its movement, the volume chamber 50 will become exhausted to a point where its pressure can no longer activate the actuator 36, and as a result the monitoring valve 32 cannot be shifted leftwardly, thus causing the shutdown of the system 10 described above.

In the manner described above, by preselectively sizing the volume chamber 50, the system can be preselectively "tuned" to accept a tolerable level of sticking or sluggish movement of the valve elements of the double safety valve 12 in order to accommodate system component tolerances, desired system sensitivities, different component sizes, or other design parameters without causing a premature, undesired shutdown. Should such factors or other design parameters change or be modified, the volume chamber 50 can optionally be made replaceable, in at least some embodiments, in order to correspondingly change the shutdown response of the monitoring subsystem.

FIG. 4 illustrates a similar reaction to a malfunction or faulted condition resulting from the sticking, undue sluggishness, or other failure of upward movement of the poppet valve assembly 46 in an out-of-sequence relationship with the poppet valve assembly 48. In a similar manner as that discussed above in connection with FIG. 3, pressurized air from the pressurized air source 11 is prevented from flowing to the pilot valves 16 and 18 because of the properly functioning leftward shifting of the monitoring valve 32, as well as the monitoring valve 30 being held in its rightward position as a result of the sticking or otherwise malfunction of the poppet valve assembly 46 in a manner similar to that described above in connection with FIG. 3. Similarly, the lines 81 and 82, which serve to actuate the piston-/exhaust valve assemblies 28 and 27, respectively, are connected to exhaust by way of the ports 63 and 65 of the leftwardly-shifted pilot valves 16 and 18, respectively. If an attempt is made to operate the control system 12 by actuating the solenoids 20 and 22, such lines 81 and 82 will still be connected to exhaust by way of the ports 62 and 64 of the pilot valves 16 and 18, respectively, the lines 78, 79, and 80, the port 56 of the rightwardly-shifted monitoring valve 30, the line 90, and the port 61 of the leftwardly-shifted monitoring valve 32. In a manner similar to that described in connection with FIG. 3, the volume chamber 50 is also similarly exhausted in the condition illustrated in FIG. 4. Thus, as described above in connection with FIG. 3, the control system 10 is rendered inoperable in response to a malfunction or faulted condition of the poppet valve assembly 46, with the volume chamber 50 functioning in a corresponding, similar manner as described above to tolerate a preselected amount of sluggishness, or time of sticking of the valve element 46.

In either the condition illustrated in FIG. 3 or the condition illustrated in FIG. 4, actuation of the lockout/reset valve 40, by way of the manual actuation element 42, will not render the control system 10 operable so long as either of the malfunction or faulted conditions illustrated in FIGS. 3 or 4 continues to exist. This is because of a feature of the self-monitoring system illustrated in FIGS. 3A and 4A, respectively.

Figure 3A:
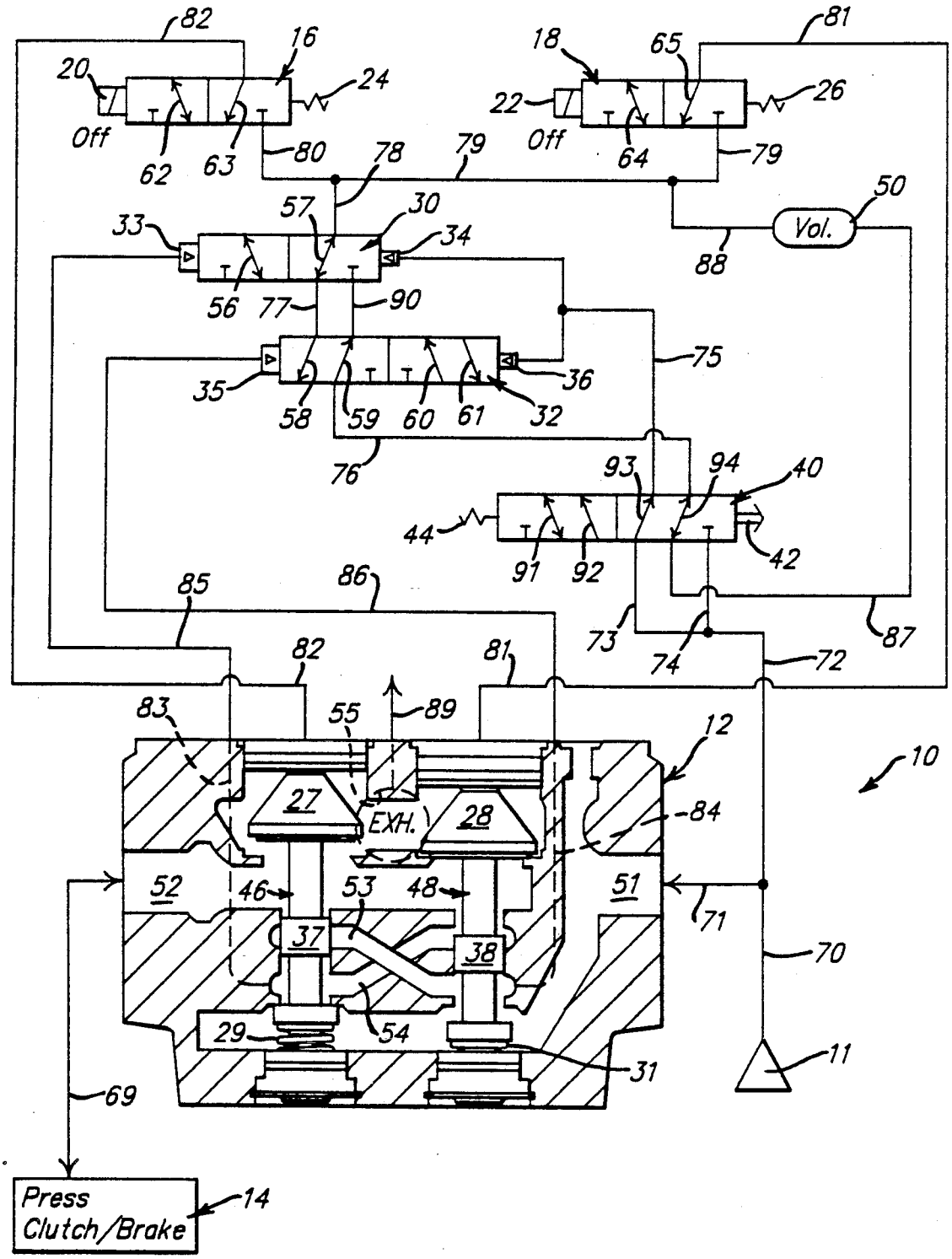
FIG. 3A is a diagrammatic view similar to that of FIG. 3, but illustrating the lockout/reset valve being actuated.
Figure 4A:
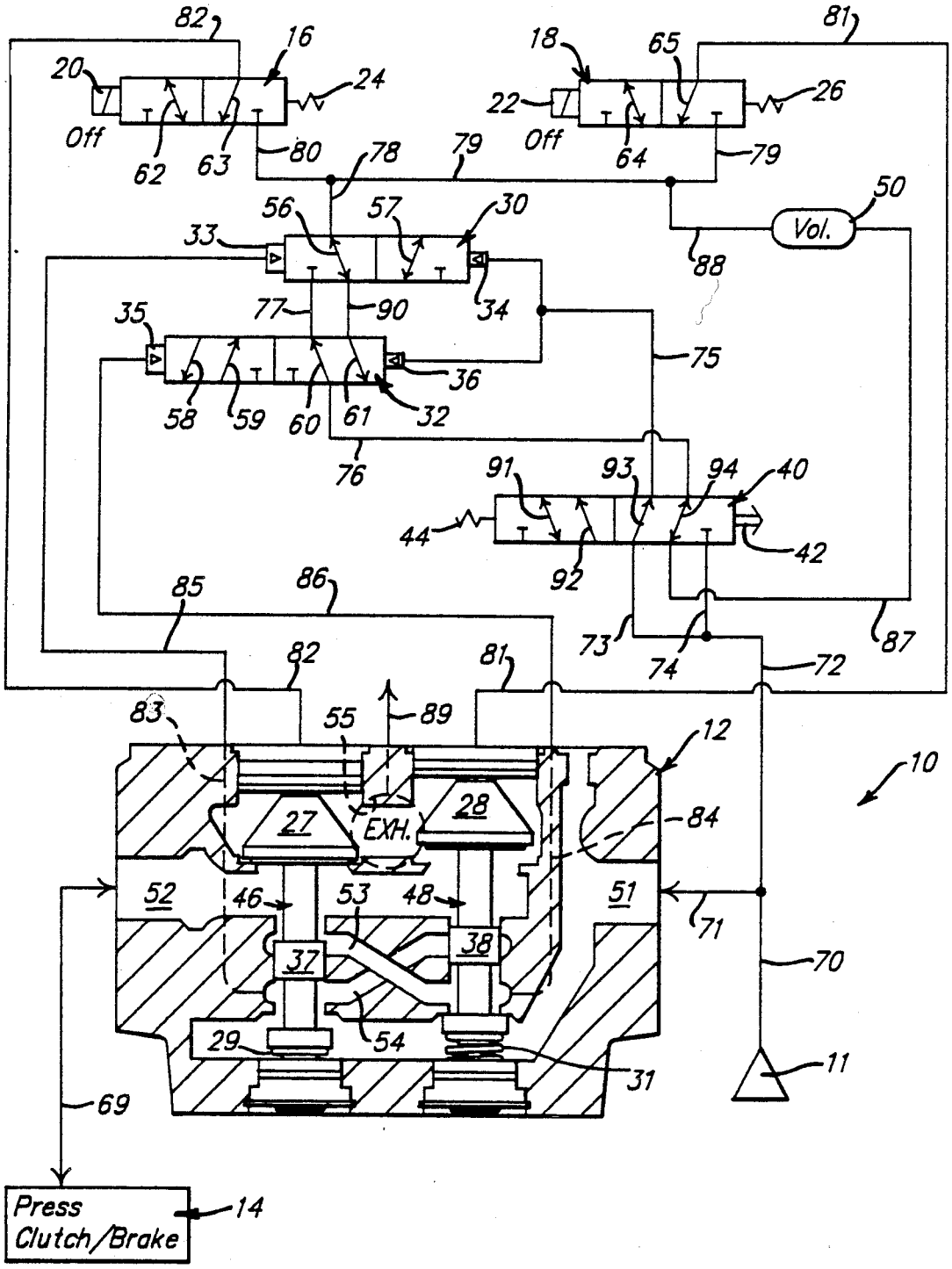
FIG. 4A is a diagrammatic view similar to that of FIG. 4, but illustrating the lockout/reset valve being actuated.

As illustrated in FIGS. 3A and 4A, leftward movement of the lockout/reset valve 40, as a result of actuating the manual actuation element 42, interconnects the line 73 with the line 75 by way of the port 93 of the lockout/reset valve 40, and similarly interconnects the line 87 with the line 76 by way of port 94 of the lockout/reset valve 40. This condition results in pressurized air being communicated to the actuator 34 in FIG. 3, thus maintaining the monitoring valve 30 in its leftwardly-shifted position, due to the actuator 33 being connected to exhaust through the line 85, the monitoring port 83 and the crossflow passage 54. Similarly, in FIG. 4, this condition causes pressurized air to be communicated to the actuator 36, thus maintaining the monitoring valve 32 in its leftwardly-shifted position. However, this condition cannot result in the leftward shifting of the monitoring valve 32 in FIG. 3A. or in the leftward shifting of the monitoring valve 30 in FIG. 4A. This is due to the fact that in FIG. 3A, pressurized air from the pressurized air source 11 is communicated by way of the faulted poppet valve assembly 48 through the port 84 and the line 86, and to the dominant actuator 35 in order to maintain the monitoring valve 32 in its rightwardly-shifted position. Similarly, in FIG. 4A, pressurized air from the pressurized air source 11 is communicated by way of the crossflow passage 54 (due to the faulted poppet valve assembly 46) the monitoring port 83, and the line 85, to the dominant actuator 33 to maintain the monitoring valve 30 in its rightwardly-shifted position. Thus, in FIG. 3A, the monitoring valve 32 is maintained in its rightwardly-shifted position due to the fact that the pneumatic actuator 35 is larger than, or capable of overcoming, the pneumatic actuator 36. Similarly, in FIG. 4A, the monitoring valve 30 is maintained in its rightwardly-shifted position due to the fact that the pneumatic actuator 33 is larger than, or capable of overcoming, the pneumatic actuator 34. As a result, in either of the conditions illustrated in FIGS. 3A or 4A, the monitoring valves 30 and 32 are maintained in an out-of-sequence, or out-of-synchronization, condition, which in turn prevents operation of the control system 10, as is described in more detail above in connection with FIG. 3 and FIG. 4, respectively. This feature of the control system 10 therefore prevents reactuation of the control system 10, by way of actuation of the lockout/reset valve 40 simultaneously with actuation of the solenoids 20 and 22, until the malfunction or faulted condition has been corrected.

Figure 5:
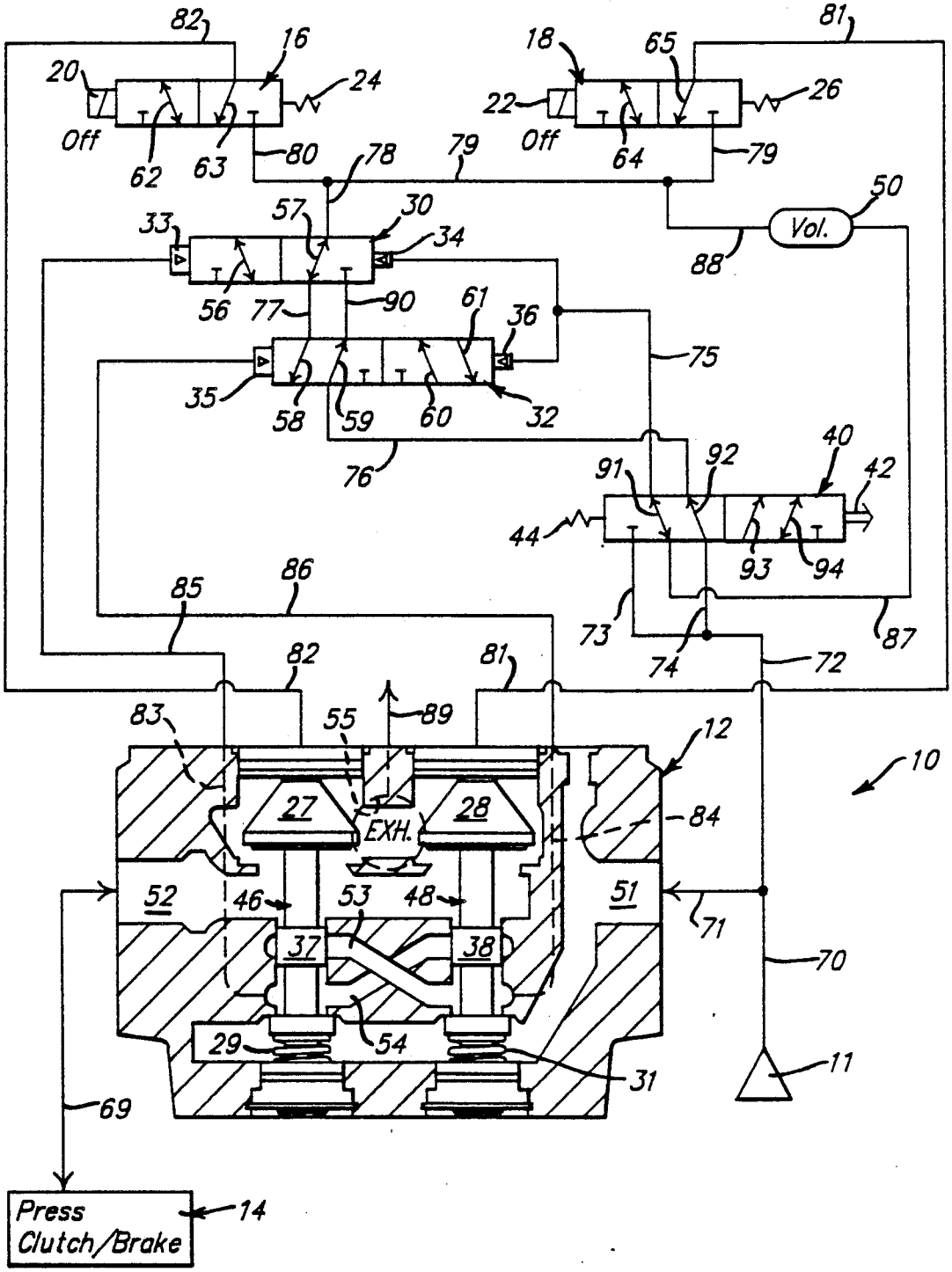
FIG. 5 is a diagrammatic view similar to FIGS. 1 through 4, but illustrating another exemplary malfunction or faulted condition, wherein both of the poppet valve elements are in their proper positions and in sequence with one another, but one of the monitoring valves of the monitoring system is stuck, sluggish, or otherwise in a faulted condition.
Figure 6:
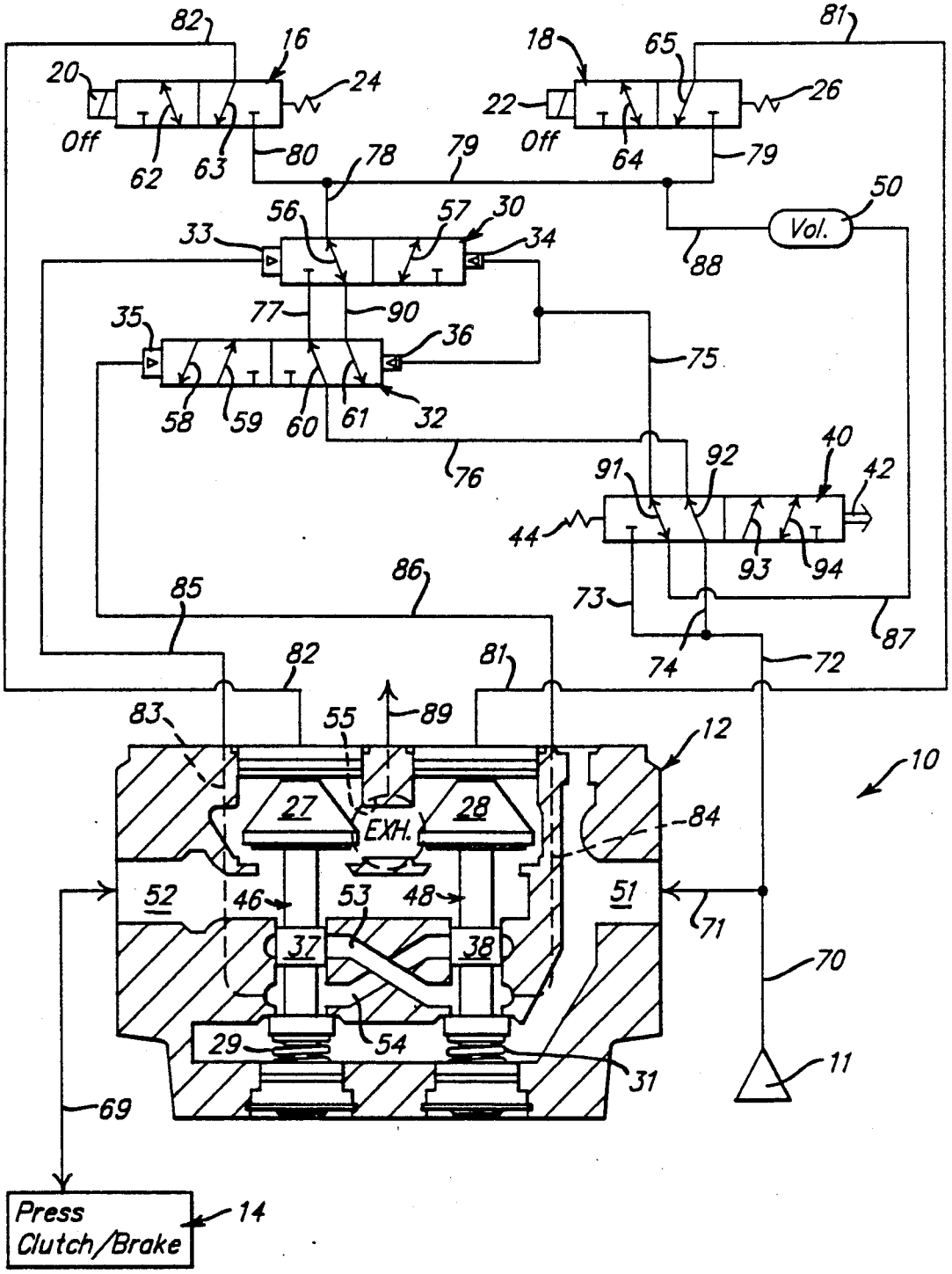
FIG. 6 is a diagrammatic view similar to FIG. 5, but illustrating a condition wherein the other of the monitoring valves is stuck, sluggish, or otherwise in a faulted condition.

FIGS. 5 and 6 diagrammatically represent respective conditions of the control system 10, wherein one of the monitoring valves 30 or 32 is stuck, unacceptably sluggish, or otherwise in a malfunctioning or faulted condition, wherein they are out of synchronization or sequence with one another. In FIGS. 5 and 6, both of the valve elements 46 and 48 of the double safety valve 12 have properly returned to their exhaust positions as a result of the lines 82 and 81 being connected to exhaust, through respective ports 63 and 65 of the pilot valves 16 and 18 upon deenergization of the solenoids 20 and 22, in a manner similar to that shown in FIG. 1. In contrast to the proper operation illustrated in FIG. 1, however, the monitoring valve 32 in FIG. 5, or the monitoring valve 30 in FIG. 6, has stuck or is unacceptably sluggish in properly returning to its leftwardly-shifted position when the respective lines 86 and 85 were exhausted.

Because of the above-described storage of pressurized air in the volume chamber 50, the volume chamber 50 will attempt to cause the respective actuators 36 or 34 to urge the malfunctioning or sluggish monitoring valve 32 or 30 leftwardly, but only so long as the pressure in the volume chamber 50 does not decrease to a level that operation of the respective actuators 36 or 34 is impossible. Such decay in volume chamber pressure is caused by the out-of-synchronized condition of the monitoring valves, which connects the volume chamber 50 to exhaust as described above in connection with FIGS. 3 and 4.

Thus, the volume chamber 50 serves to accommodate a preselected acceptable time lag in proper shifting of the monitoring valves 30 or 32 in a manner similar to that described above for accommodating a preselected acceptable time lag in the shifting of the main valve elements 46 or 48. After such acceptable time lag, however, the monitoring valves 30 and 32 remain in their out-of-sequence positions and cause a system shutdown as described above in connection with FIGS. 3 and 4. This is an important innovation because it alerts the operator to an unacceptable faulted condition or malfunctioning of the monitoring system, which could result in a failure to detect a later main valve fault or malfunction if the system were allowed to continue operating with an improperly functioning monitoring system. Thus, the present invention is self-monitoring, both in terms of main valve malfunctions and/or monitoring system malfunction. This feature, along with the constantly dynamic nature of the monitoring valves, which tends to prevent or minimize monitoring valve malfunctions, contributes greatly to the enhanced reliability of the system of the present invention.

Figure 5A:
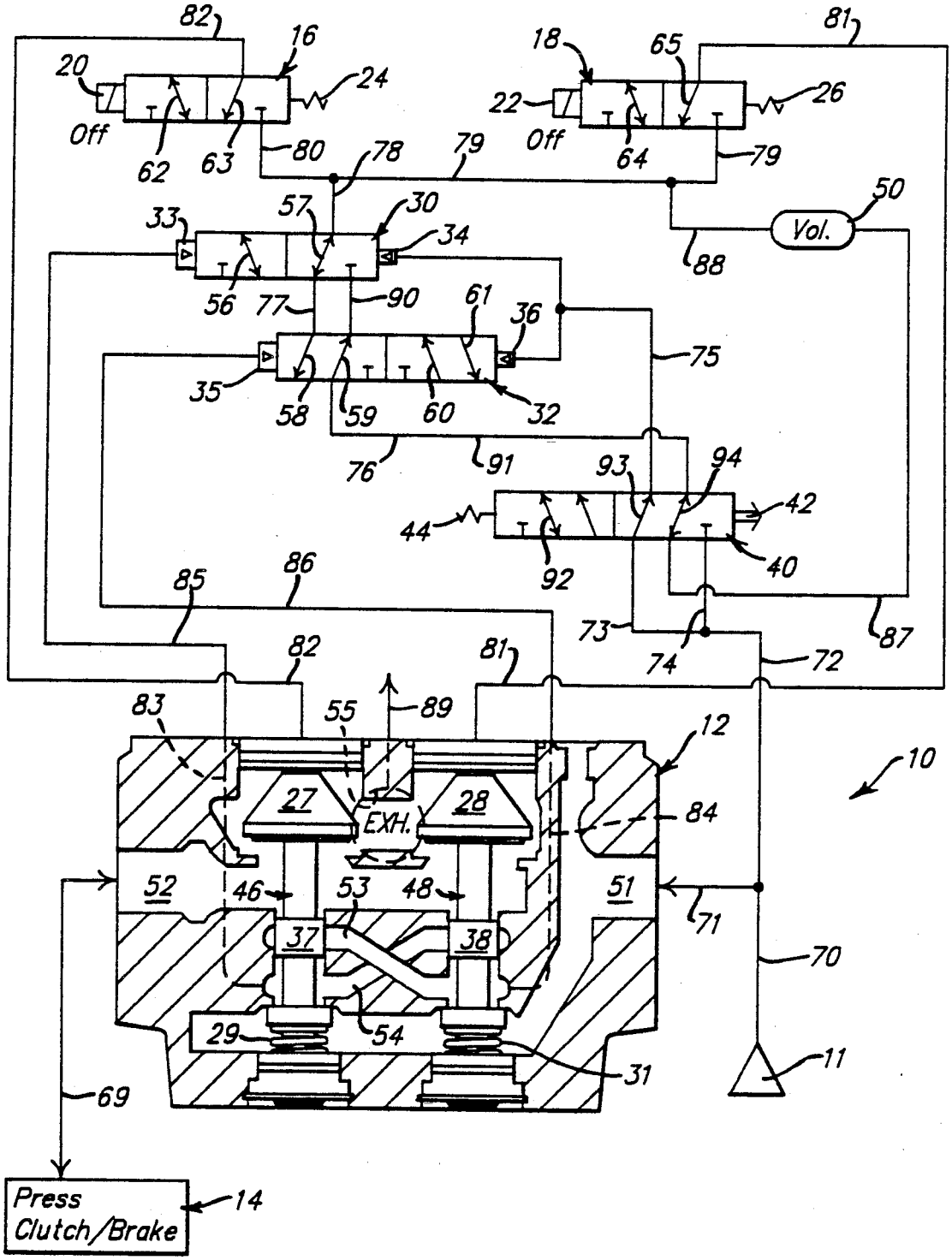
FIG. 5A is a diagrammatic view similar to that of FIG. 5, but illustrating the lockout/reset valve being actuated.
Figure 6A:
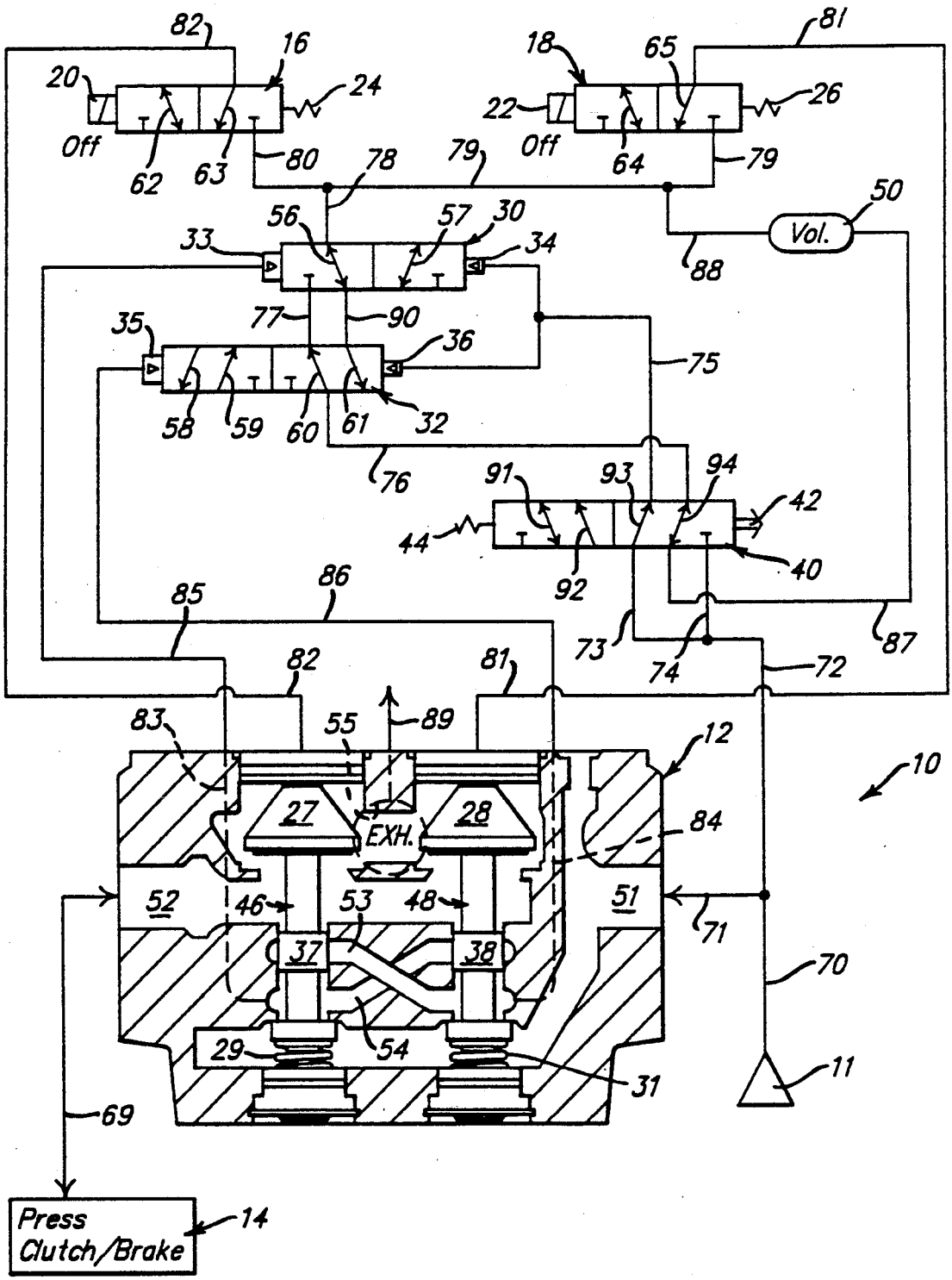
FIG. 6A is a diagrammatic view similar to that of FIG. 6, but illustrating the lockout/reset valve being actuated.

As illustrated in FIGS. 5A and 6A, the invention also prevents a faulted system to be reactuated by simultaneously operating the solenoids 20 and 22 and the reset/lockout valve 40 if the faulted condition has not been corrected. In FIGS. 5A and 6A, the reset/lockout valve 40 functions in a manner similar to that described above for FIGS. 3A and 4A, respectively, to prevent reactuation of the system 10 when the monitoring valves 30 and 32 are out of synchronization, whether such out-of-synchronization condition results from a main valve or a monitoring valve malfunction.

Figure 7:
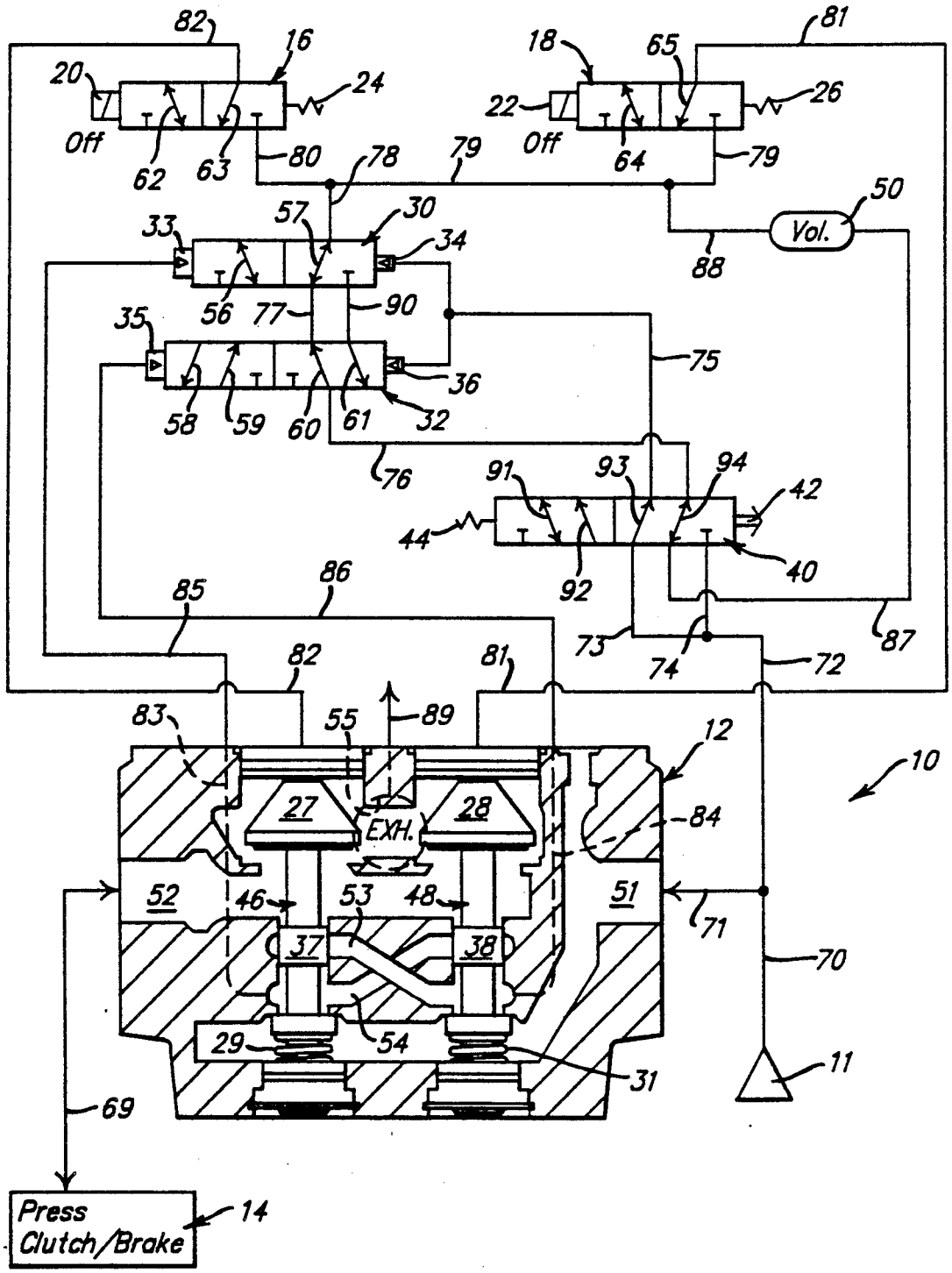
FIG. 7 is a diagrammatic view similar to that of FIGS. 1 through 5, but illustrating a properly-operating or corrected double safety valve and monitoring system, with the reset valve being actuated in order to reactivate the system.

In FIG. 7, the proper function of the reset/lockout valve 40 is illustrated for reactuating the system when both the double safety valve 12 and the monitoring subsystem have been corrected or are in proper operating condition. Leftward shifting of the reset/lockout valve 40 connects the pressurized air source 11 to the actuators 34 and 36, through the lines 70, 72, and 73, the port 93, and the line 75, in order to shift the monitoring valves 30 and 32 leftwardly to their proper starting positions, as in FIG. 1. Once they are in these proper starting positions, the manual actuation element 42 can be released to allow the reset/lockout valve 40 to be shifted rightwardly under the force of the return spring 44. Once released, the reset/lockout valve 40 connects the air source 11 to the volume chamber 50 for refilling, through lines 70, 72, and 74, the port 92, and through the lines 76, 77, 78, 79 and 88, as well as the monitoring valve ports 60 and 57. As the volume chamber 50 fills to its proper pressure level, it functions to continue to maintain the monitoring valves 30 and 32 in the leftwardly-shifted positions, thus returning the system 10 to its FIG. 1 condition, ready for proper cycling operation, as described above in connection with FIGS. 1 and 2. As described above, however, in connection with FIGS. 3A, 4A, 5A, and 6A, the reset/lockout valve 40 cannot perform this resetting function if the main poppet valve elements 46 and 48 are out of sequence or if the monitoring valves 30 and 32 are out of sequence.

Thus, one skilled in the art will now readily appreciate the innovative and highly advantageous features of the present invention, including the constantly dynamic nature of the monitoring valves, the self-monitoring nature of the monitoring subsystem, in addition to monitoring the function of the double safety valve, the capability of the monitoring subsystem to act as a damper for the system and to tolerate and accommodate preselected acceptable levels of component sluggish or delay, as well as other highly desirable features of the invention.

The foregoing discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A monitoring system for a pneumatic control system having a control valve assembly, the control valve assembly having an inlet, an outlet, an exhaust, and at least a pair of control valve elements, the control valve elements each being movable between at least two positions for controlling the flow of pressurized air between the inlet and the outlet and between the outlet and the exhaust, the control valve elements being adapted to move together in sequence with one another between their respective positions during normal operation, said monitoring system comprising:

monitoring means for detecting relative movement of the control valve elements out of sequence with one another and for preventing further operation of the control system in response to said detection of said out-of-sequence movement of the control valve elements; and self-monitoring means for detecting a malfunction of said monitoring means and for preventing further operation of the control system in response to said detection of said malfunction of said monitoring means, said monitoring means including at least a pair of monitor valve elements each having port means therein, said monitor valve elements being movable together in sequence with one another between at least a pair of respective valving positions during normal operation, said monitoring means including means for moving said monitor valve elements to out-of-sequence positions in response to said detection of said out-of-sequence movement of the control valve elements, and fluid communication means interconnecting said monitor valve elements for preventing further operation of the control system when said monitor valve elements are out of said sequence with one another.

2. A monitoring system according to claim 1, wherein said monitor valve elements normally move together in sequence with one another each time said control valve elements move together in sequence with one another.

3. A monitoring system according to claim 1, further comprising means for delaying for a predetermined period of time said prevention of further operation of the control system as a result of said detection of said relative out-of-sequence movement of the control valve elements.

4. A monitoring system according to claim 1, further comprising means for delaying for a predetermined period of time said prevention of further operation of the control system as a result of said detection of said malfunction of said monitoring means.

5. A monitoring system according to claim 1, further comprising means for preventing a resumption of operation of the control system whenever the control valve elements are out of sequence with one another.

6. A monitoring system according to claim 1, further comprising means for preventing a resumption of operation of the control system whenever said monitor valve elements are out of sequence with one another.

7. An arrangement for sensing a malfunction in a pneumatic control system for presses and like devices comprising a pressure inlet, a supply outlet, and an exhaust, a pair of control valve means each having three control valving parts operated thereby, the first of each control valving part being effective to control the communication of pressure from said inlet to a respective intermediate pressure area of each of said control valve means, the second of each of said control valving parts being effective to control the communication of the intermediate pressure are of the other of said control valve means with said supply outlet, and the third of each of said control valving parts being effective to control the communication of said supply outlet with said exhaust, said control valve means each being movable between a first position wherein said first and second control valve parts are closed and said third control valve parts are opened and a second position wherein said first and second control valve parts are opened and said third control valve parts are closed for communicating said inlet with said supply outlet and for closing communication of said supply outlet with said exhaust when both of said control valve members are in their second positions, for closing communication of said inlet with said intermediate pressure areas, closing communication of said intermediate pressure areas with said supply outlet and opening communication of said supply outlet with said exhaust when said control valve means are both in their first position, and for precluding communication of inlet pressure to said supply outlet when both of said control valve means are not in their second position, the improvement comprising monitoring means responsive to actual pressure for sensing pressure in either of said intermediate pressure areas for providing a malfunction signal when said control valve means are in different positions out of sequence with one another and for preventing further operation of the control system in responses to said control valve means being out of sequence with one another, said monitoring means including at least a pair of monitor valve means each having port means therein, said monitor valve means being movable together in sequence between at least a pair of respective valving positions during normal operation in response to said control valve means moving together in sequence with one another between their respective first and second positions, one of said monitor valves being movable at least in part in response to said sensing of pressure in one of said intermediate pressure areas, and the other of said monitor valve means being movable at least in part in response to said sensing of pressure in the other of said intermediate pressure areas, said monitoring means including means for moving said monitor valve means to different positions out of sequence with one another in response to different pressures in said intermediate pressure areas, and fluid communication means interconnecting said monitor valve elements for preventing further operation of said control system in response to said monitor valve means being in said different positions out of sequence with one another.

8. An arrangement according to claim 7, wherein said monitor valve means normally move together in sequence with one another each time said control valve means move together in sequence with one another.

9. An arrangement according to claim 8, wherein said monitoring means also includes means for preventing further operation of said control system in response to said monitor valve means being in different positions out of sequence with one another regardless of whether said control valve means are out of sequence with one another.

10. An arrangement according to claim 9, wherein said monitoring means further includes damper means for delaying for a predetermined period of time said prevention of further operation of the control system as a result of said monitor valve means being in said different positions out of sequence with one another.

11. An arrangement according to claim 10, wherein said damper means includes a volume chamber for storing a predetermined quantity of pressurized air, said volume chamber being in fluid communication with both of said monitor valve means, said monitor valve means also being movable in response to the pressure in said volume chamber.

12. An arrangement according to claim 11, further comprising means for preventing resumption of operation of the control system whenever said control valve means are out of sequence with one another.

13. An arrangement according to claim 12, further comprising means for preventing resumption of operation of the control system whenever said monitor valve means are out of sequence with one another.

14. An arrangement for sensing a malfunction in a pneumatic control system for presses and like devices comprising a pressure inlet, a supply outlet, and an exhaust, a pair of control valve means each having three control valving parts operated thereby, the first of each control valving part being effective to control the communication of pressure from said inlet to a respective intermediate pressure area of each of said control valve means, the second of each of said control valving parts being effective to control the communication of the intermediate pressure area of the other of said control valve means with said supply outlet, and the third of each of said control valving parts being effective to control the communication of said supply outlet with said exhaust, said control valve means each being movable between a first position wherein said first and second control valve parts are closed and said third control valve parts are opened and a second position wherein said first and second control valve parts are opened and said third control valve parts are closed for communicating said inlet with said supply outlet and for closing communication of said supply outlet with said exhaust when both of said control valve members are in their second positions, for closing communication of said inlet with said intermediate pressure areas, closing communication of said intermediate pressure areas with said supply outlet and opening communication of said supply outlet with said exhaust when said control valve means are both in their first position, and for precluding communication of inlet pressure to said supply outlet when both of said control valve means are not in their second position, the improvement comprising monitoring means responsive to actual pressure for sensing pressure in either of said intermediate pressure areas for providing a malfunction signal when said control valve means are in different positions out of sequence with one another, said means for sensing pressure including a pair of pressure sensing ports each extend from one of said intermediate pressure areas of the respective control valve means to said monitoring means, said monitoring means including means for preventing further operation of the control system in response to said control valve means malfunction signal means for preventing further operation of the control system in response to a malfunction of said monitoring means itself regardless of whether said malfunction exists in said control valve means, and at least a pair of movable monitoring valve means, said monitoring means being moved together in sequence with one another each time said control valve means move together in sequence with one another.

15. An arrangement according to claim 14, wherein said monitoring system includes means for moving said monitor valve means to different positions out of sequence with one another in response to said control valve means malfunction.

16. An arrangement according to claim 15, wherein said monitoring means also includes means for preventing further operation of said control system in response to said monitor valve means being in different positions out of sequence with one another regardless of whether said control valve means are out of sequence with one another.

17. An arrangement according to claim 16, wherein said monitoring means further includes damper means for delaying for a predetermined period of time said prevention of further operation of the control system as a result of said monitor valve means being in said different positions out of sequence with one another.

18. An arrangement according to claim 17, wherein said damper means includes a volume chamber for storing a predetermined quantity of pressurized air, said volume chamber being in fluid communication with both of said monitor valve means, said monitor valve means also being movable in response to the pressure in said volume chamber.

19. An arrangement according to claim 18, further comprising means for preventing resumption of operation of the control system whenever said control valve means are out of sequence with one another.

20. An arrangement according to claim 19, further comprising means for preventing resumption of operation of the control system whenever said monitor valve means are out of sequence with one another.

* * * * *